US007048550B2

(12) United States Patent
Hyland et al.

(10) Patent No.: US 7,048,550 B2
(45) Date of Patent: May 23, 2006

(54) ELECTRICAL ADAPTER ASSEMBLY

(75) Inventors: James H. Hyland, Harrisburg, PA (US); Iosif R. Korsunsky, Harrisburg, PA (US); Charles S. Blichasz, Boiling Springs, PA (US); Kevin E. Walker, Hershey, PA (US); Michael A. Yeomans, Camp Hill, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 14 days.

(21) Appl. No.: 10/871,144

(22) Filed: Jun. 18, 2004

(65) Prior Publication Data

US 2005/0282442 A1 Dec. 22, 2005

(51) Int. Cl.
*H01R 23/02* (2006.01)

(52) U.S. Cl. ..... 439/67; 439/540.1

(58) Field of Classification Search ..... 439/676, 439/540.1, 638, 607

See application file for complete search history.

(56) References Cited

U.S. PATENT DOCUMENTS 4,362,905 A * 12/1982 Ismail ..... 379/442
4,406,509 A * 9/1983 Jagen ..... 439/354
4,444,451 A 4/1984 Myers ..... 439/344
4,500,159 A * 2/1985 Briones et al. ..... 439/607
4,799,901 A 1/1989 Pirc ..... 439/620
4,904,209 A * 2/1990 Nelson ..... 439/676
5,666,408 A * 9/1997 Lao ..... 379/442
5,775,946 A * 7/1998 Briones ..... 439/607
6,729,913 B1 * 5/2004 Bruski et al. ..... 439/676
6,761,585 B1 * 7/2004 Clark et al. ..... 439/540.1

OTHER PUBLICATIONS http://cctr.umkc.edu/ref/ele/rj45.html, Printoff.

* cited by examiner

*Primary Examiner*—Michael C. Zarroli
(74) *Attorney, Agent, or Firm*—Wei Te Chung

(57) ABSTRACT

An electrical adapter (100) includes a first housing member (1), a second housing member (2) coupled with the first housing member, and a number of first, second and third conductive terminals (312, 322, 332). The first housing member has a first mating face (11) defining a first upper and lower receptacles (111, 112). The second housing member has a second mating face (21) defining a second receptacle (211). The first, second and third conductive terminals (312, 322, 332) respectively have contacting portions (314, 324, 334) extending into corresponding receptacles. Latching means are arranged between the first and second housing members so as to fasten the first housing member and the second housing together.

21 Claims, 17 Drawing Sheets

3d

ELECTRICAL ADAPTER ASSEMBLY

CROSS-REFERENCE TO RELATED APPLICATION

This application is related to a U.S. patent application entitled "ELECTRICAL CONNECTOR HAVING SURGE SUPPRESSING DEVICE", invented by the same inventor and assigned to the common assignee as the present invention.

BACKGROUND OF THE INVENTION

1. Field of the Invention

The present invention relates to electrical connectors and more particularly to multi-outlet adapter for distributing identical signal so as to increase the utilization of existing receptacles for plug-in modular plugs.

2. Description of the Prior Art

RJ modular connectors have been widely used in telecommunication systems ever since they were first created and adopted by the industry. An RJ45 modular connector, which includes a total of eight terminals, and RJ11 modular connectors, which can include two, four, or six terminals, have been widely used in the network systems and telephone equipment, respectively.

Among hundreds of different applications of the RJ45, there are at least eight different patterns in selecting terminals as differential pair, i.e. T568A, T568B, USOC 4-pair, USOC 1-, 2- or 3-pair, 10BASE-T (802.3), Token Ring (802.5), 3-pair (MMJ), and TP-PMD (X3T9.5) and ATM. In each implementation, two terminals are selected as a pair in which some are close to each other, while some are apart from each other. Each pattern has its own uniqueness, while each also carries a coupling issue that needs to be solved.

Among those patterns, T568A and T568B are widely used and in T568A, terminals 1,2 configure $3^{rd}$ pair, terminals 3,6 configure $2^{nd}$ pair, terminals 4,5 configure $1^{st}$ pair, while terminals 7,8 configure $4^{th}$ pair. In T568B, terminals 1,2 configure $2^{nd}$ pair, terminals 3,6 configure $3^{rd}$ pair, terminals 4,5 configure $1^{st}$ pair, while terminals 7,8 configure $4^{th}$ pair.

However, in the TP-PMD and ATM application, as best seen in http://cctr.umkc.edu/ref/ele/rj45.html only $1^{st}$, $2^{nd}$, $7^{th}$ and $8^{th}$ terminals are used, while $3^{rd}$, $4^{th}$, $5^{th}$, and $6^{th}$ terminal are left unused. If an existing RJ45 is used in T568A and T568B applications, a total of eight terminals are used, while in TP-PMD and ATM application, 50% of the terminals are left unused.

U.S. Pat. No. 4,444,451 issued to Myers on Apr. 24, 1984 discloses a modular plug-dual modular jack adapter.

U.S. Pat. No. 4,799,901 issued to Pirc on Jan. 24, 1989 discloses a modular adapter comprising upper and lower housings, first and second connector subassemblies, a transient voltage suppression module and a grounding shell. The first and second connector subassemblies include, respectively, first and second dielectric support members and eight first and second terminals. The transient voltage suppression module includes a circuit board having a plurality of electrical circuit components mounted thereon, and grounding strap having grounding legs extending through apertures in the circuit board. However, the structure of the Pirc adapter requires numerous components and procedures, it is overly complicated such that production cost is increased. Furthermore, in Pirc adapter, signals are transmitted form the first terminals to the second terminals, while 50% of the terminals are left unused.

Hence, an improved adapter suitable for telecommunication is required to overcome the disadvantages of the prior art.

SUMMARY OF THE INVENTION

An object of the present invention is to provide an improved adapter with a simplified structure for interconnecting two or more pieces of electronic equipments.

Another object of the present invention is to provide an electrical adapter having an improved housing providing which is reliable and easily to be assembled.

A further object of the present invention is to provide an electrical adapter having improved terminals installed therein.

A still further object of the present invention is to provide an electrical adapter having an improved grounding means shielding the adapter.

A yet further object of the present invention is to provide a modular jack having a relatively inclined mating face for mating with a complementary connector.

An electrical adapter includes a first housing member, a second housing member coupled with the first housing member, and a plurality of conductive terminals assembled into the first and second housing member. The first housing member has a first mating face defining first upper and lower receptacles. The second housing member has a second mating face defining a second receptacle. The terminals are arranged into two sets. Each terminal includes first and second mating portion. The first mating portions of the terminals of each set are arranged in the first upper and lower receptacles, respectively, and the second mating portions of the terminals of the two sets are arranged commonly in the second receptacle.

Other objects, advantages and novel features of the invention will become more apparent from the following detailed description when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures as following.

DETAILED DESCRIPTION OF THE INVENTION

Figure 1:
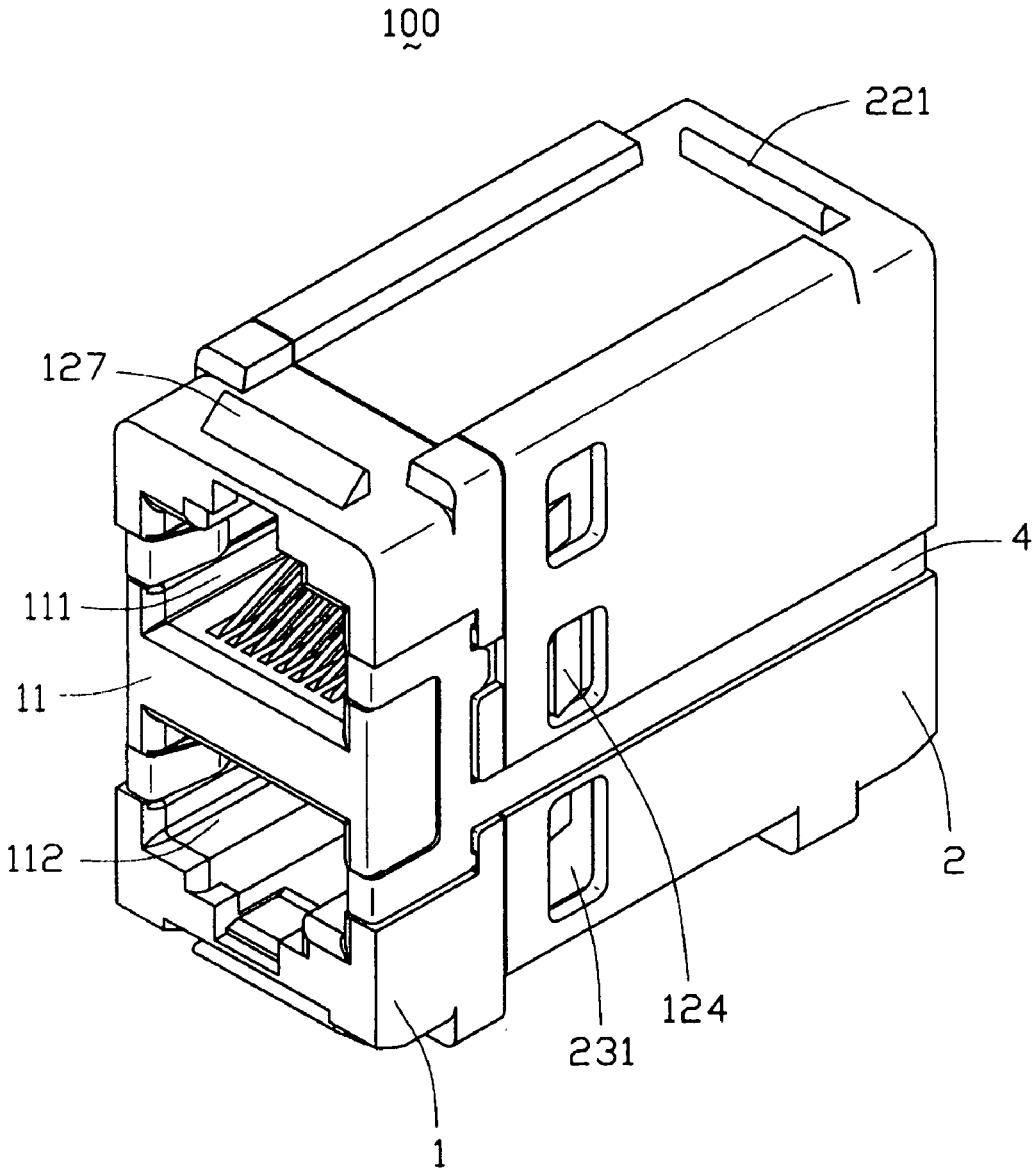
FIG. 1 is a perspective view of an adapter of a first embodiment according to the present invention.
Figure 2:
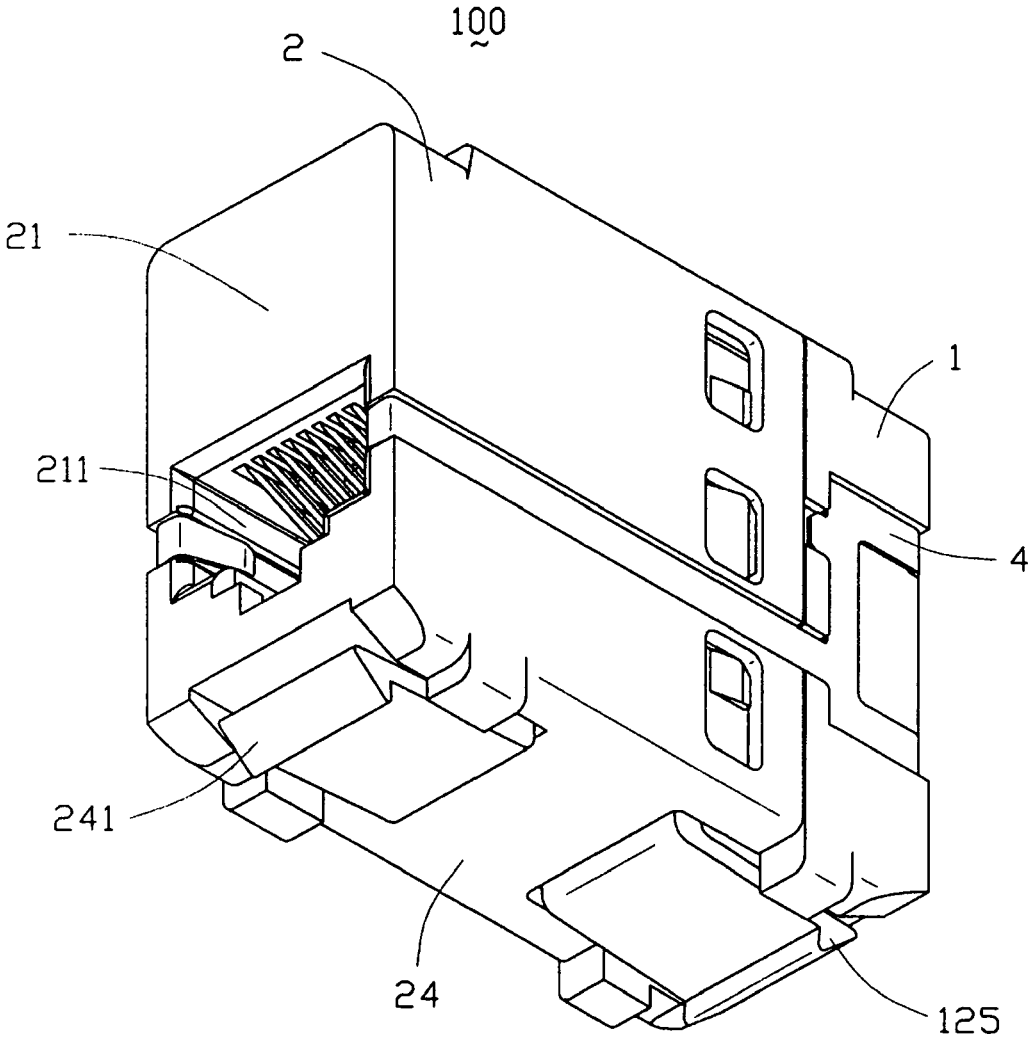
FIG. 2 is another perspective view of FIG. 1.

Referring to FIGS. 1, 2, 7, 13–15 and 17, an electrical adapter 100 comprises a dielectric housing having a first and second mating faces 11, 21. The first mating face 11 has at least two first receptacles, and the second mating face 21 has a second receptacle. For purpose of illustration, the adapter 100 is shown as a network coupler having a plurality of modular jacks, such as RJ-45 or RJ-11 receptacles, for particularly connecting between pieces of modular plugs. In using, signals are transmitted from the second receptacle in the second mating face 21 and split into the first receptacles in the first mating face 11. The second receptacle in the second mating face 21 is substantially an RJ-45 receptacle, and the first receptacles in the first mating face 11 may include a pair or more of RJ-45 receptacles, or one RJ-45 receptacle and one RJ-11 receptacle, or one RJ-45 receptacle and a pair or more of RJ-11 receptacles. As we all know, the conventional RJ-45 modular connector comprises four terminal differential pairs, but only two terminal differential pairs are used for 10 megabits per second and 100 megabits per second applications, resulting in wasted material and increased weight. In the present invention, the adapter 100 has provisions to selectively remove contact pairs that are not needed. Nonetheless, when needed for applications requiring operating speeds such as 1000 megabits per second, more terminal differential pairs of the RJ-45 modular connector are available. However, it should be understood that various features of the invention are equally applicable for other types of connectors, as will be fully understandable from the following detailed description.

Figure 3:
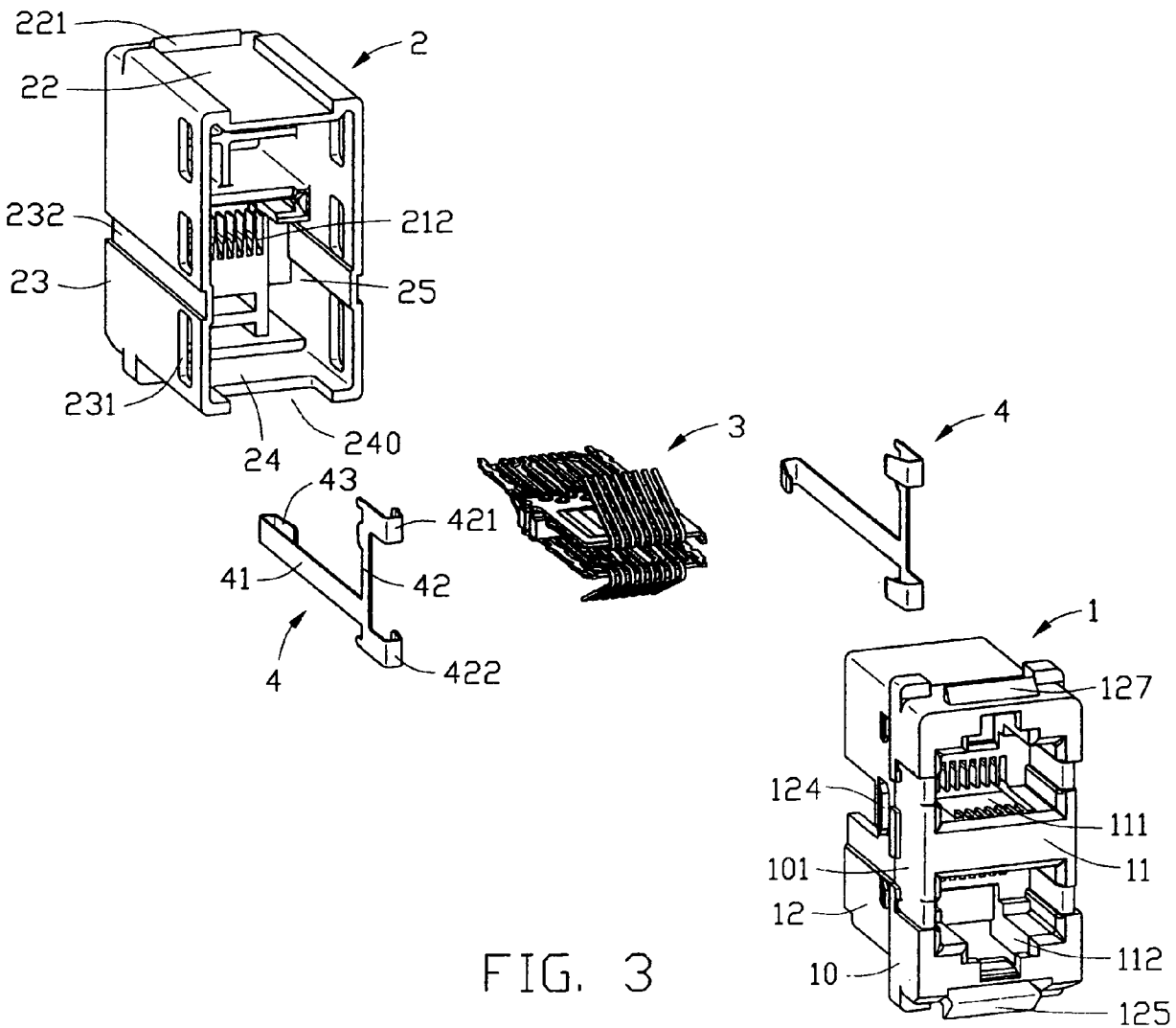
FIG. 3 is an exploded view of FIG. 1.
Figure 4:
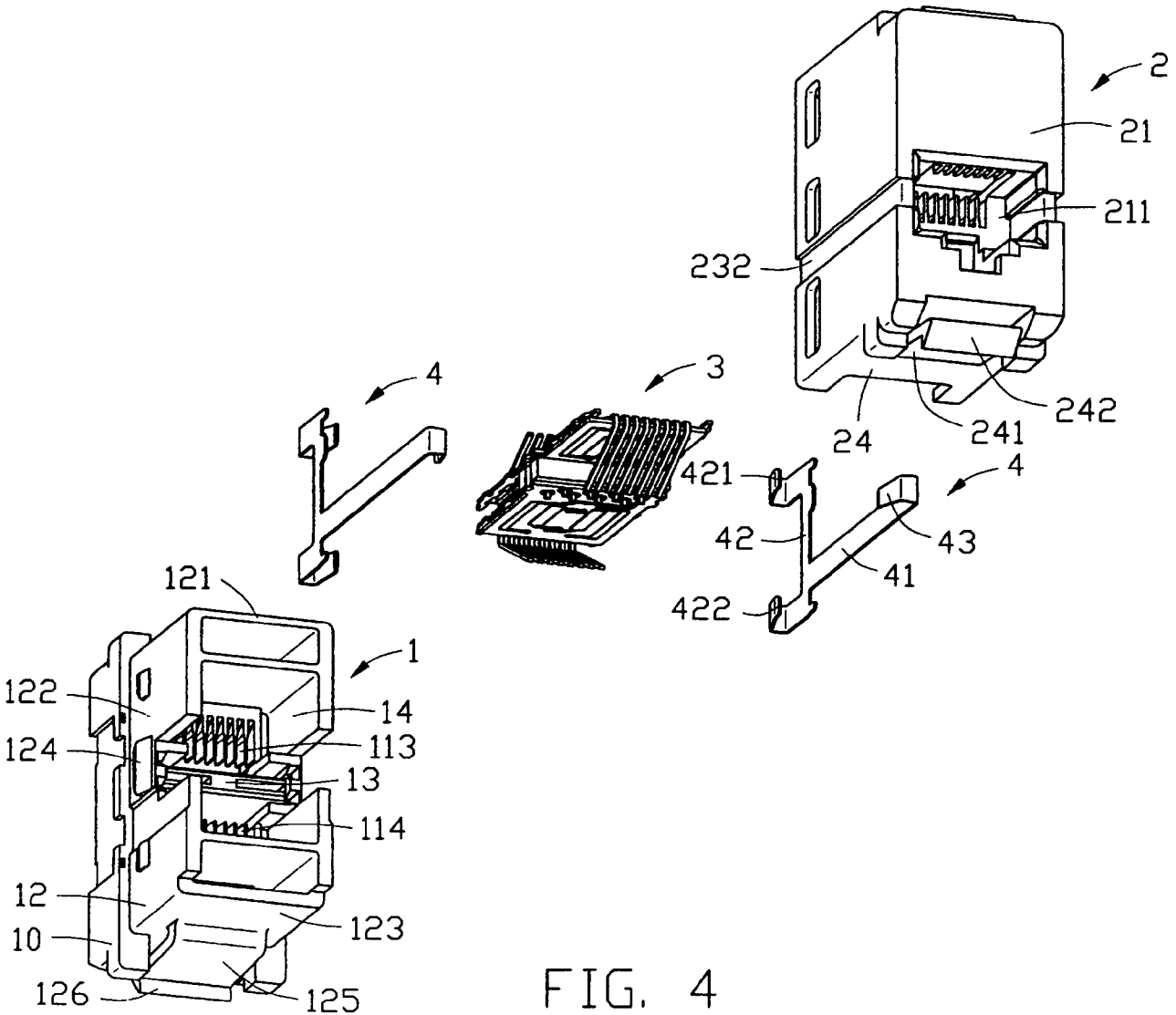
FIG. 4 is another exploded view of the FIG. 3.

Referring to FIGS. 3 and 4, the dielectric housing comprises a first and second housing members 1, 2 coupled together, a subassembly 3 received in the dielectric housing and a pair of grounding clips 4 attached opposite sides of the dielectric housing.

The first housing member 1 is substantially rectangular ladder shaped and includes a front base portion 10 and a rear coupling portion 12 for engaging with the second housing member 2. The front base portion 10 has a first mating face 11 providing a first upper and lower receptacles 111, 112 extending rearwardly thereinto for receiving complementary connectors (not shown) therein. A pair of mounting recesses 101 are defined on opposite sides of the first upper and lower receptacles 111, 112 for receiving the grounding clips 4. The first upper receptacle 111 shares a dividing wall 13 with the first lower receptacle 112. The coupling portion 12 comprises a pair of rear sidewalls 122, a rear upper wall 121 connecting with upper portions of the sidewalls 122 and a rear bottom wall 123 connecting with lower portions of the sidewalls 122, thereby defining a first receiving space 14 therein. Each rear sidewall 122 has a plurality of outwardly projecting locking portions 124 for engaging with the second housing member 2. A plurality of first upper and lower passageways 113, 114 are provided on a respective side of the dividing wall 13, and, respectively, communicating with the first upper and lower receptacles 111, 112 and the first receiving space 14. The rear bottom wall 123 provides a first lower latching portion 125 extending downwardly and forwardly toward the first mating face 11. The first lower latching portion 125 includes a planar portion (not labeled) essentially parallel to and spaced from the rear bottom wall 123, and a downwardly projecting tapered portion 126 at a free end thereof. The base portion 10 further has a first upper latching portion 127 extending upwardly from a top surface thereof. The first upper and lower latching portions 127, 125 are provided to engage with counterpart portions of an electrical equipment (not shown) on which the adapter 100 is mounted, thereby securely assembling the adapter 100 to the electrical equipment.

The second housing member 2 is coupled to the first housing member 1 to define an internal space (not labeled) for receiving the subassembly 3 therein. The second housing member 2 includes a second mating face 21 providing a second receptacle 211 extending forwardly thereinto, a second upper wall 22, two second sidewalls 23, a second bottom wall 24 and a second receiving space 25. Each second sidewall 23 defines a plurality of locking holes 231 for engaging with corresponding locking portions 124 of the first housing member 1, and a groove 232 for accommodating a corresponding grounding clip 4. The second housing member 2 further provides a plurality of second passageways 212 communicating with the second receptacle 211 and the second receiving space 25. The second bottom wall 24 includes an opening 240 in a front portion and a second lower latching portion 241 in a rear portion. The opening 240 communicates with the second receiving space 25 for receiving the first lower latching portion 125 of the first housing member 1. The second lower latching portion 241 includes a planar portion (not labeled) and a downwardly projecting tapered portion 242. The first and second lower latching portions 125, 241 are identical in configuration and structure except that they are oriented to opposite directions. The second upper wall 22 has a second upper latching portion 221 projects upwardly therefrom. The second upper and lower latching portions 221, 241 are provided to act as the same function as the first upper and lower latching portions 127, 125.

Referring to FIGS. 7, 13, 16 and 17, the subassembly 3 includes a plurality of conductive terminals. Said terminals can be stamped from metal sheet and configured as continued terminals, especially shown in FIG. 17. Said terminals also can be alternated designed separately and have subsections interconnected by circuit traces on one or more circuit boards, as best seen in FIGS, 7, 13 and 16. Said terminals are arranged into two sets and each includes first and second mating portions. The first mating portions of the terminals of each set are arranged in the first upper and lower receptacles 111, 112, respectively. The second mating portions of the terminals of the two sets are arranged commonly in the second receptacle 211.

Figure 5:
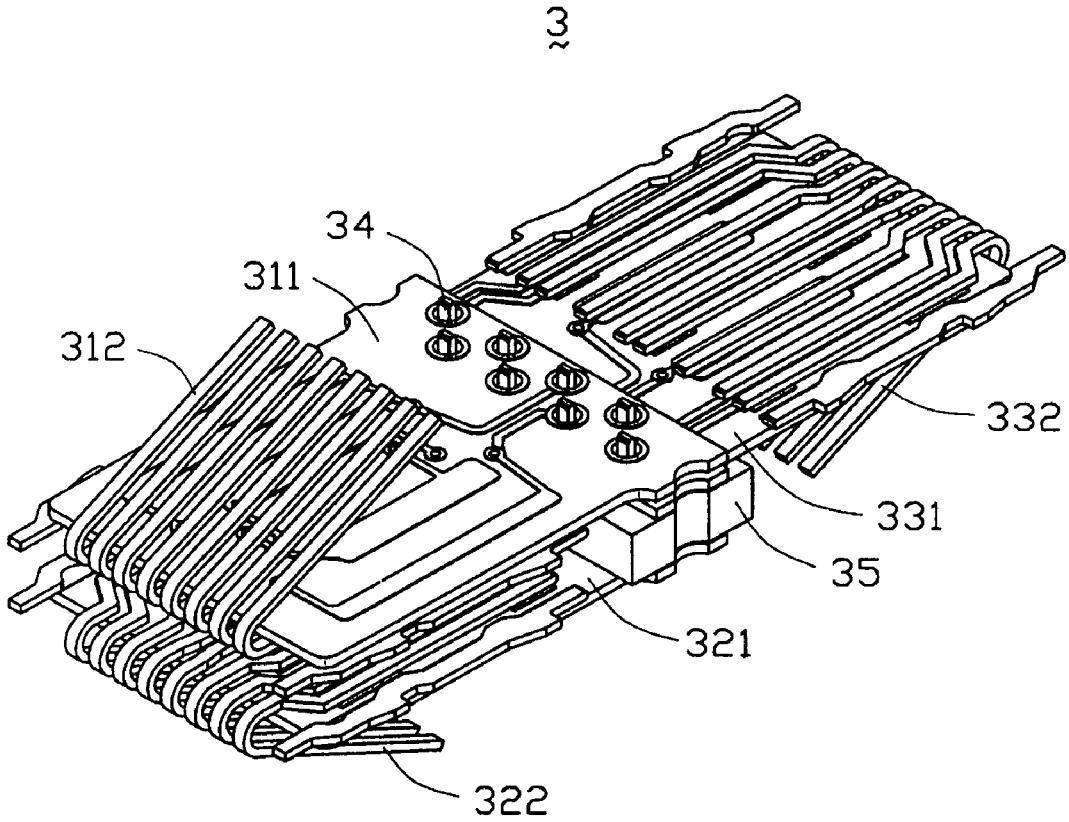
FIG. 5 is an enlarged view of a subassembly of the adapter shown in FIG. 3.
Figure 6:
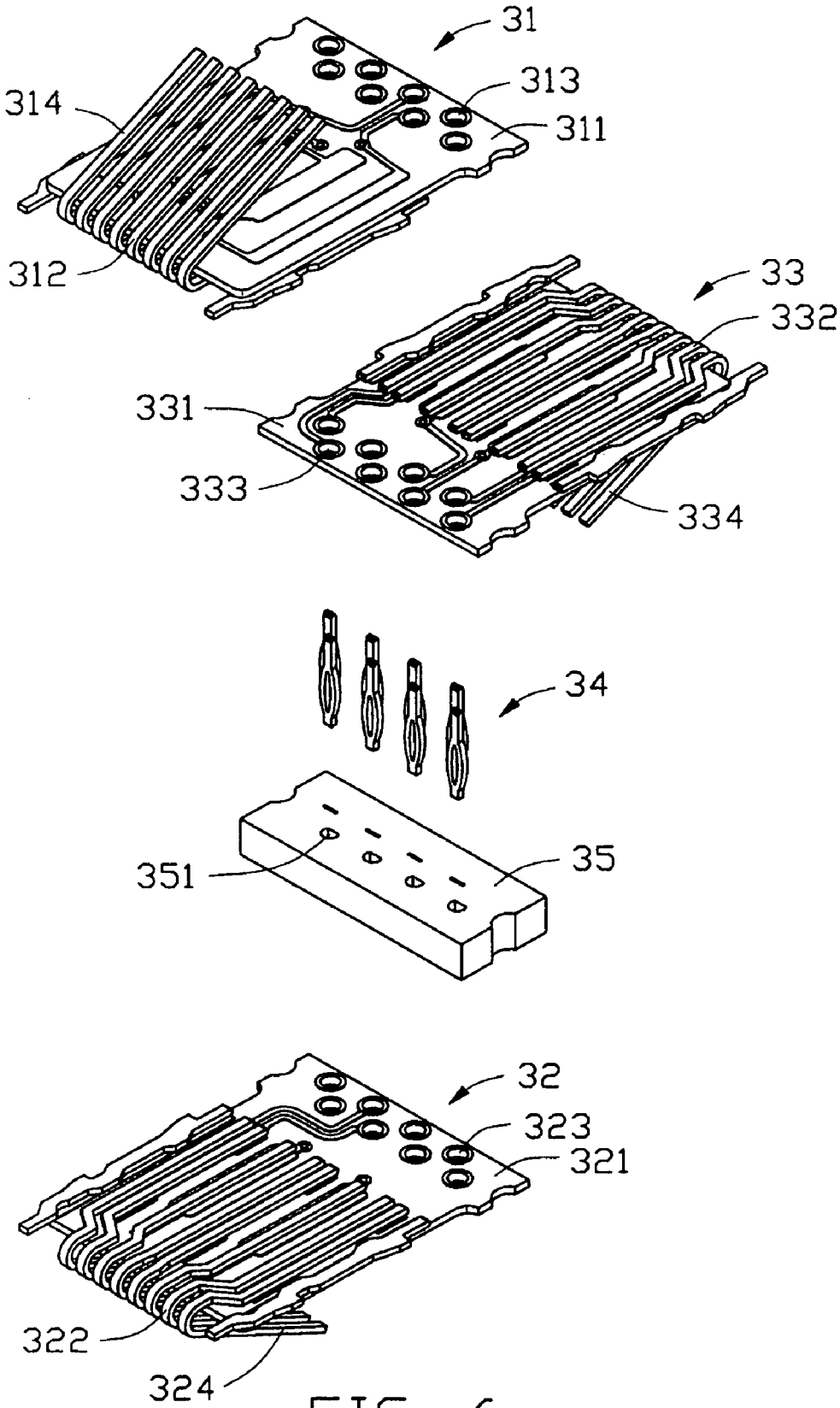
FIG. 6 is an exploded view of the subassembly of FIG. 5.

As best shown in FIGS. 5 and 6, in the illustrated embodiment, the subassembly 3 includes a first, second and third terminal modules 31, 32, 33, a plurality of needled-shaped contact pins 34 and a middle insulator 35 defining a plurality of through holes 351 for receiving corresponding contact pins 34 therein. The first, second and third terminal modules 31, 32, 33 respectively include a first, second and third printed circuit board (PCB) 311, 321, 331 and a plurality of first, second and third conductive terminals 312, 322, 332. The first, second and third PCBs 311, 321, 331 comprise, respectively, a plurality of first, second and third circuit traces (not labeled) thereon and a plurality of first, second and third mounting holes 313, 323, 333 through corresponding traces. The middle insulator 35 is dimensioned to be sandwiched between the second and third PCBs 321, 331 to provide a predetermined distance to space the first PCB 311 from the second PCB 321. Each first (second, third) conductive terminal 312 (322, 332) includes a first (second, third) mounting portion (not labeled) soldered to the first (second, third) PCB 311 (321, 331) and a first (second, third) contacting portion 314 (324, 334) angled outwardly and rearwardly relative to the first (second, third) mounting portion. The first, second and third terminals 312, 322, 332 respectively electrically connect with first, second and third mounting holes 313, 323, 333 through the first, second, and third circuit traces. A plurality of barbs (not labeled) are formed on opposite sides of the first (second, third) PCB 311 (321, 331) for latchably engaging with the housing means. It can be seen that the first, second and third PCBs 311, 321, 331 each includes crosstalk compensation components and a ground plane to isolate the first and second receiving receptacles 111, 112, 211. The first, second and third PCBs 311, 321, 331 can also have a common ground plane inside the PCBs to act as a shield from the first upper and lower receptacles 111, 112. Transient voltage suppressors and additional noise suppressing components can also be easily added to the subassembly 3 when needed. It should be noted that, the first (second, third) PCB 311 (321,331) is substantially multi-layered for traces and has adequate area to place a number of components for modify the electrical signals. Such components can be passive electrical components such as transformers, resistors, common mode chokes, capacitors, incandescent lamps and as such, and active components such as varistors, thyristors, transistors, integrated circuits, light emitting diodes, and electromechanical components such as switches, relays, indicators, and transient voltage suppressors.

Referring to FIGS. 3 and 4, the grounding clips 4 are stamped from a metal sheet and are substantially T-shaped. Each grounding clips 4 comprises a horizontal beam 41, a vertical beam 42 extending vertically from a front end of the horizontal beam 41, a rear grounding finger tab bent inwardly and forwardly from a rear end of the horizontal beam 41 for abutting against the second sidewall 23 of the second housing member 2. An upper and lower grounding finger tabs 421, 422 bend inwardly and rearwardly from upper and lower edges of the vertical beam 42 for abutting against the first upper and lower receptacles 111, 112 respectively.

As best shown in FIGS. 5 and 6, in assembly, firstly, to assemble the subassembly 3, the contact pins 34 are fitted in the through holes 351 of the middle insulator 35 with upper and lower portions (not labeled) thereof extending beyond the through holes 351. The second terminal module 32 is coupled to a bottom surface of the middle insulator 35, through which the lower portions of the contact pins 34 extend into corresponding second mounting holes 323 and then are soldered therein. The third terminal module 33 is attached to a top surface of the middle insulator 35. The upper portions of the contact pins 34 extend through corresponding third mounting holes 333 and are soldered therein. The first terminal module 31 is placed over the third terminal module 33 thereafter. The upper portions of the contact pins 34 extend through corresponding first mounting holes 313 and are soldered therein. Therefore, the contact pins 34 electrically connect with corresponding first, second and third conductive terminals 312, 322, 332 via corresponding first, second and third circuit traces.

Figure 7:
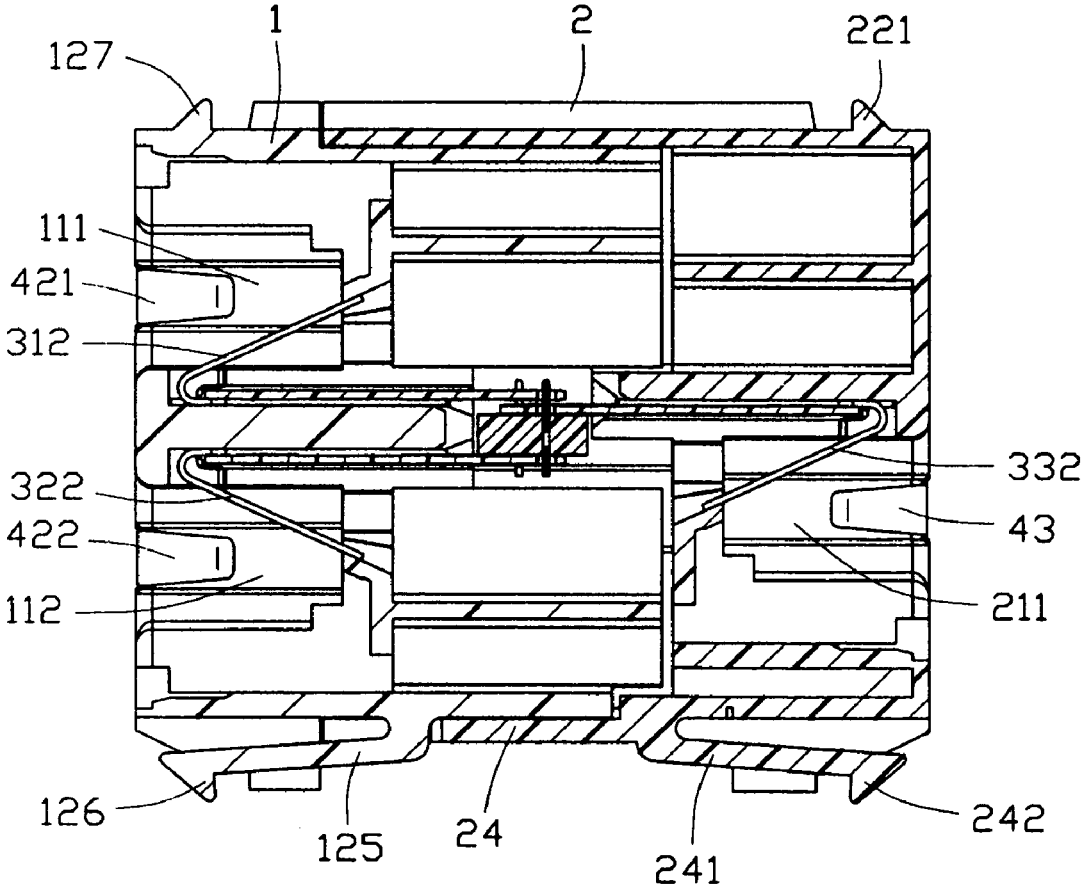
FIG. 7 is a cross-sectional view of FIG. 1 taken along line 7—7.

Referring to FIGS. 3, 4, 7 in conjunction with FIG. 5, the subassembly 3 is embedded in the first housing member 1 from a first receiving space 14. The first and second PCBs 311, 321 respectively extend forwardly along top and bottom surfaces of the dividing wall 13. The first and second conductive terminals 312, 322 extend through corresponding first upper and lower passageways 113, 114 and exposed in corresponding first upper and lower receptacles 111, 112. The second housing member 2 couples with the first housing member 1 to form the adapter 100. The second receiving space 25 of the second housing member 2 is placed over the coupling portion 12 of the first housing member 1. The first and second receiving space 14, 25 communicate with each other to defining the internal space. The locking holes 231 of the second housing member 2 lock with the locking portion 124 of the first housing member 1. The third conductive terminals 332 extend through respective ones of the second passageways 212 and extend into the second receiving receptacle 211 for mating with the complementary connector (not shown). The first latching portion 125 of the first housing member 1 is received in the opening 240 of the second housing member 2. The grounding clips 4 are attached to opposite sides of the housing means. The horizontal beams 41 of the grounding clips 4 are received in corresponding grooves 232 of the second housing member 2. The rear grounding finger tabs 43 of the grounding clips 4 abut against opposite inner side surfaces of the second receptacle 211. The vertical beams 42 of the grounding clips 4 are fixed in the mounting recess 101 of the first housing member 1. The upper and lower grounding finger tabs 421, 422 respectively abut against opposite inner side surfaces of the first upper and lower receptacles 111, 112. The rear, upper and lower grounding finger tabs 43, 421, 422 are respectively disposed in the receptacles 111, 112, 211 to provide a continuous ground path in applications that mate with shielded or grounded modular plugs.

It should be noted that latches between the first and second housing member 1, 2 can be replaced by other measures such as adhesive or ultrasonic welding. It is also should be noted that the first (second, third) conductive terminals 312 (322, 332) are selectively removed to create special contact pairs as needed. LED indicators (not shown) can also be easily added to the electrical adapter 100.

Figure 8:
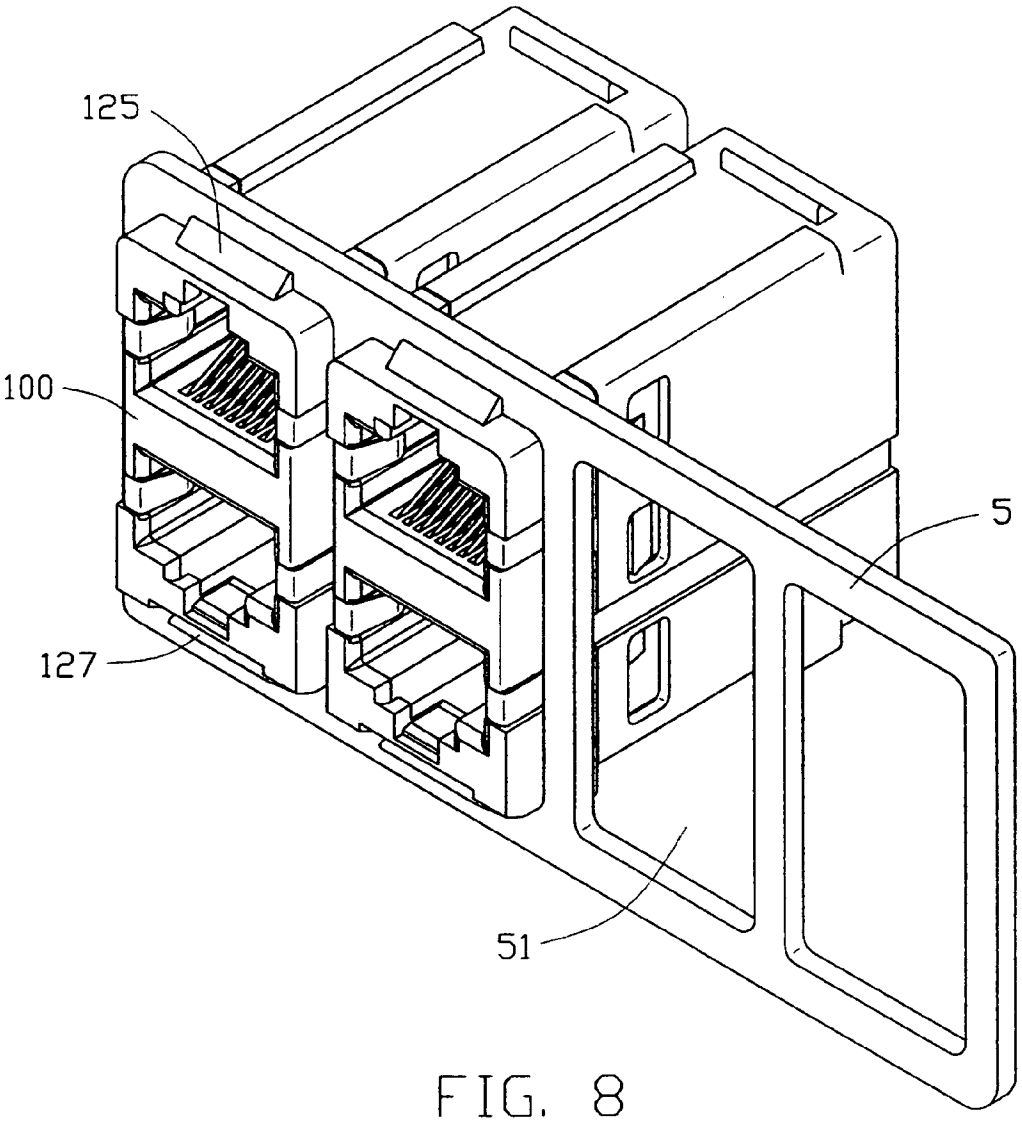
FIG. 8 is a perspective view of the adapters mounted on a panel.
Figure 9:
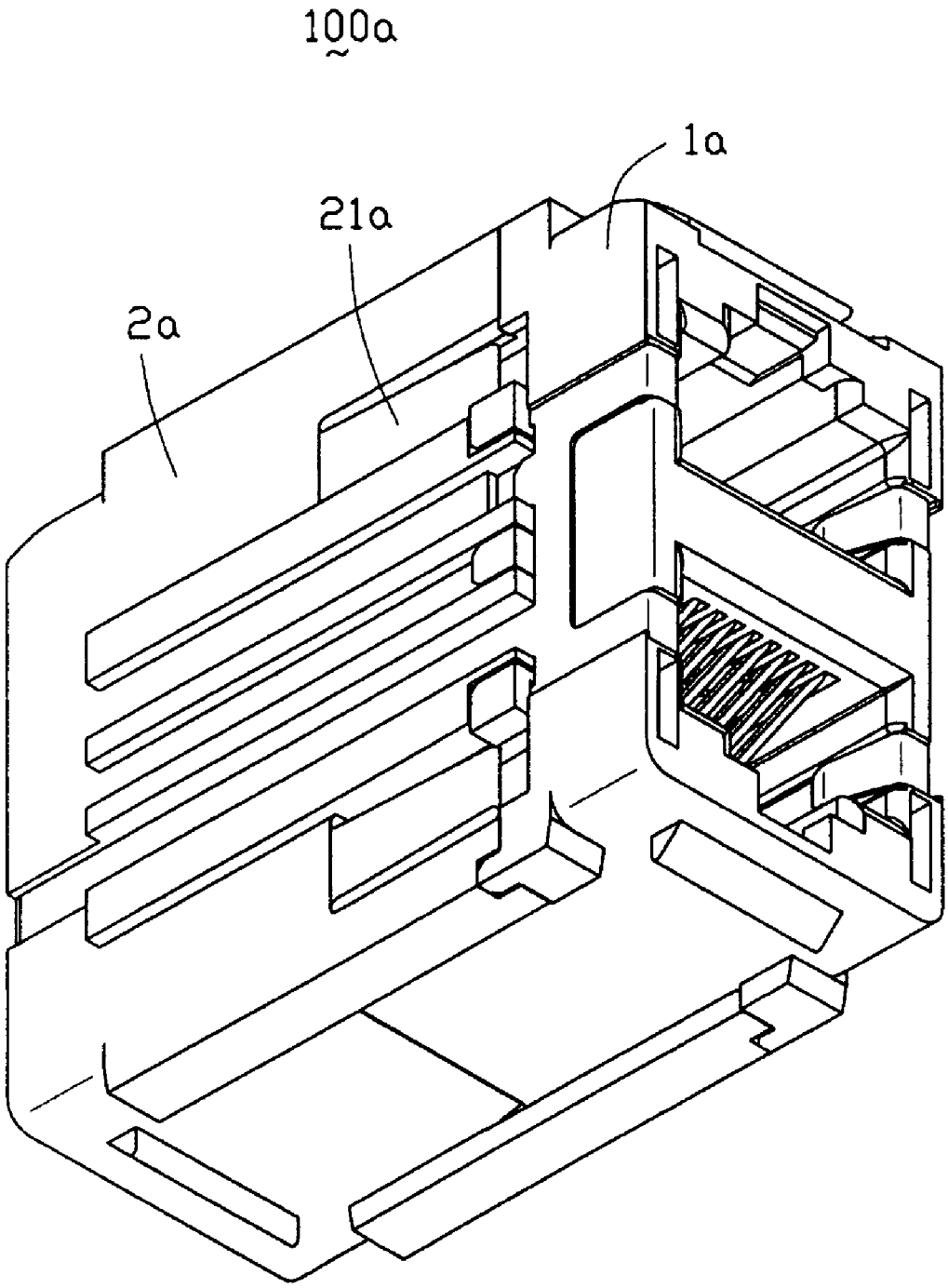
FIG. 9 is a perspective view of the adapter in a second embodiment according to the present invention.
Figure 10:
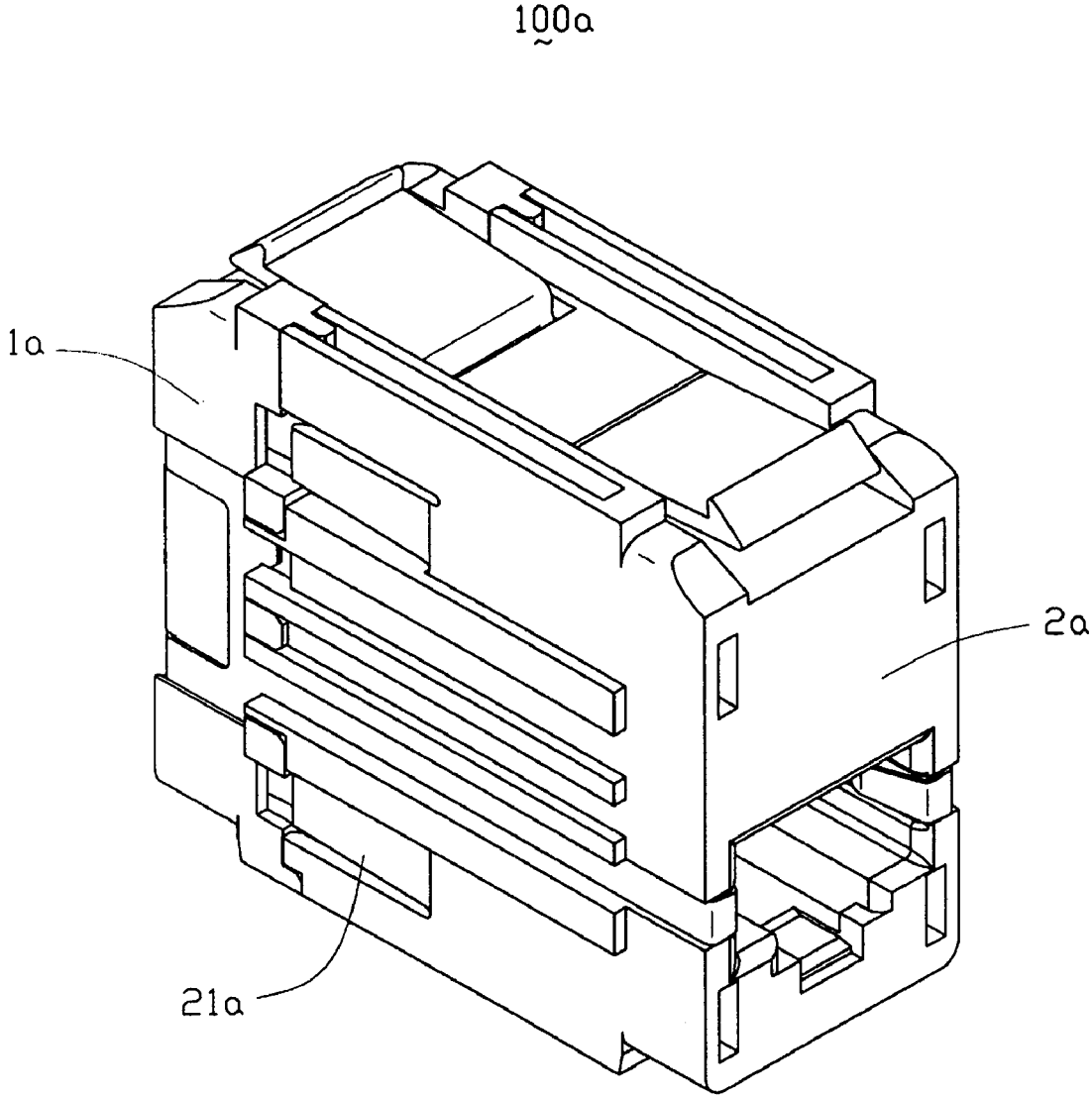
FIG. 10 is another perspective view of FIG. 9.
Figure 11:
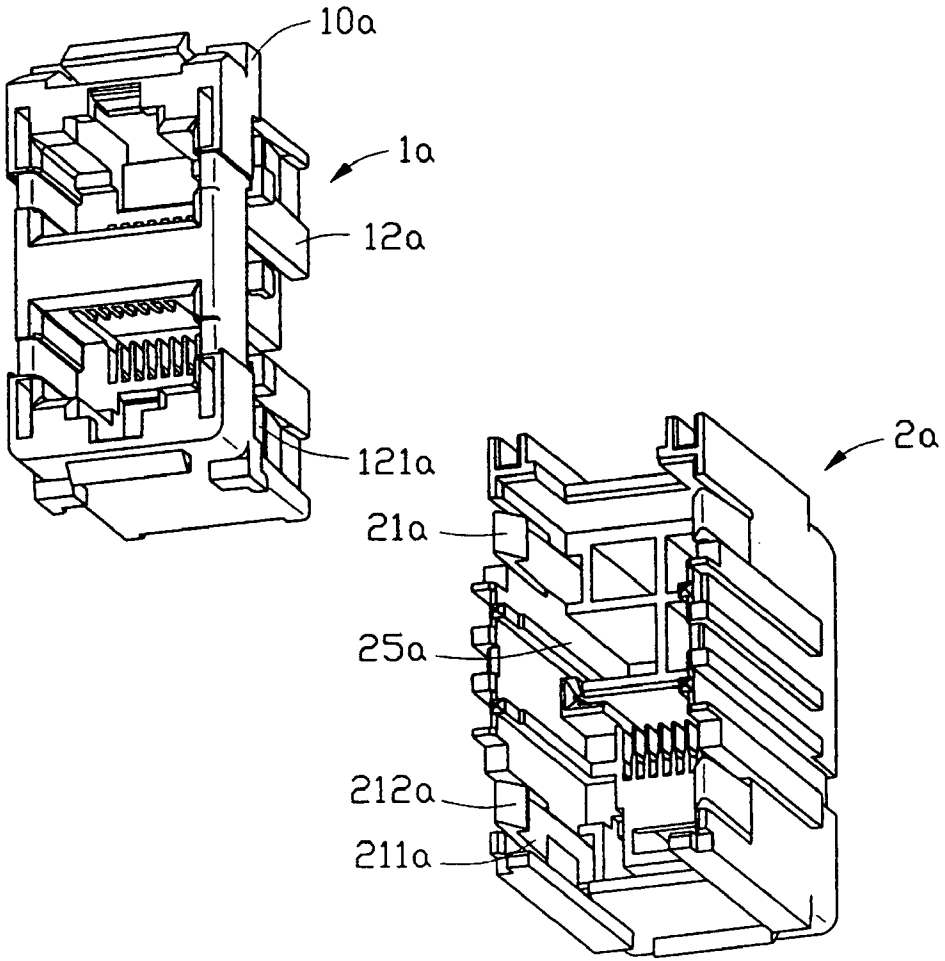
FIG. 11 is an exploded view of a dielectric housing shown in FIG. 9.
Figure 12:
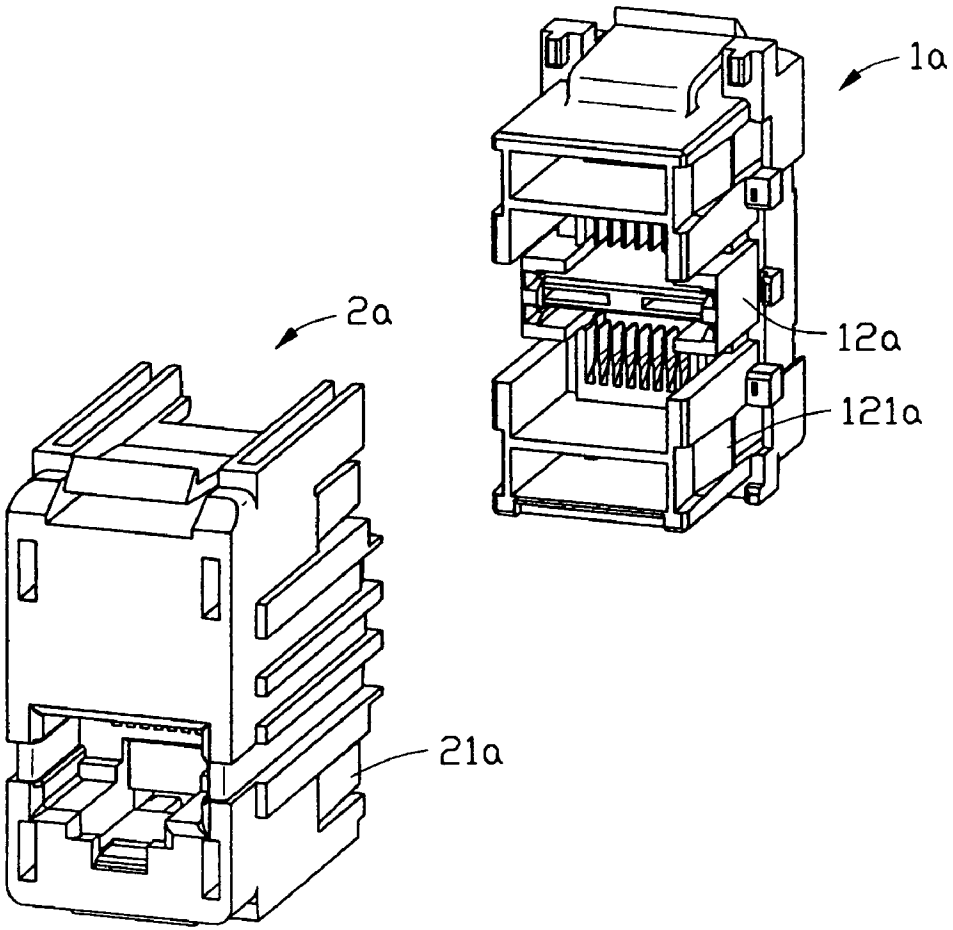
FIG. 12 is another exploded view of FIG. 11.

As best shown in FIG. 8, a plurality of adapters 100 are mounted on a panel 5 with first mating faces 11 exposed outside. A plurality of windows 51 are side-by-side arranged in the panel 5. Each adapter 100 is retained in a corresponding window 51 with the first upper and lower latching portions 127, 125 abutting against upper and lower window frames of the window 51. It is clear that the adapters 100 also can be mounted on the panel 5 with the second upper and lower latching portions 221, 241 biasing against upper and lower window frames of the window 51.

FIGS. 9–12 show a second embodiment of an electrical adapter 100*a* in accordance with the present invention. The adapters 100, 100*a* in the first and second embodiments are identical in configuration and structure except that they have different housing means. Therefore, a detailed description about other components in the second embodiment is omitted here. Housing of a second embodiment includes a first and second housing members 1*a*, 2*a* coupled together. The first and second housing members 1*a*, 2*a* are similar to the earlier-described first and second housing members 1, 2 except that the second housing member 2*a* has two pairs of latching arms 21*a* latchably engaging with engaging portions 12*a* of the first housing member 1*a*. The first housing member 1*a* includes a front base portion 10*a* and a coupling portion 12*a* having two pairs of taper-shaped engaging portions 121*a* on opposite sides thereof. The second housing member 2*a* has two pairs of the latching arms 21*a* symmetrical positioned on opposite sides. Each latching arm 21*a* is substantially flexible and includes a body portion 211*a* integrally formed with the second housing member 2*a* and a tapered locking portion 212*a* projecting into a rear opening 25*a* of the second housing member 2*a*. When the second housing member 2*a* is attached to the first housing member 1*a*, the locking portions 212*a* of the latching arms 21*a* latchably engage with the engaging portions 121*a*.

Figure 13:
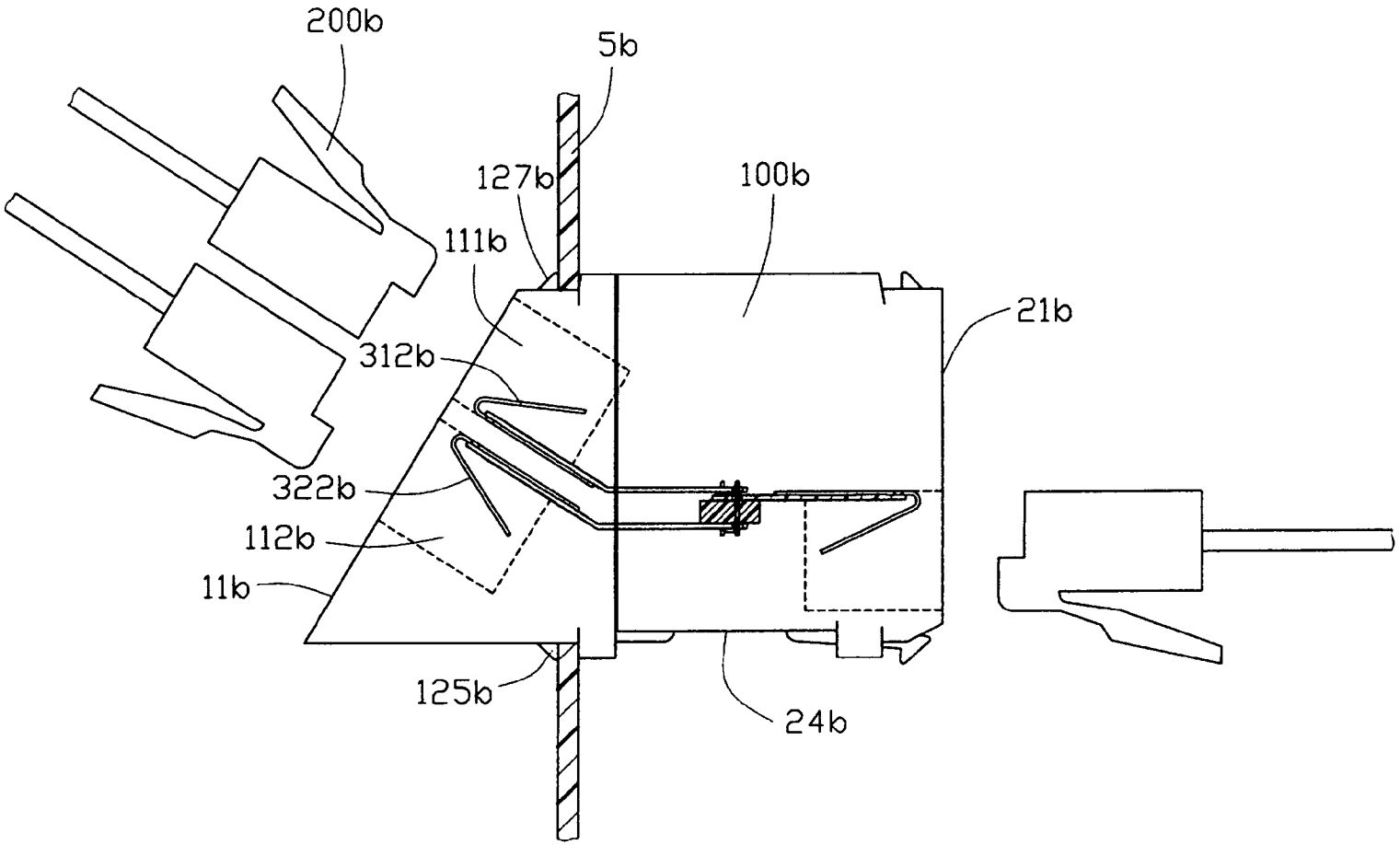
FIG. 13 is a sketch view of the adapter in a third embodiment.

Referring to FIG. 13, an electrical adapter 100*b* in a third embodiment according to the present invention will be illustrated. The adapter 100*b* in the third embodiment is similar to the adapter 100 in the first embodiment except that the adapter 100*b* provides a front mating face 11*b* inclined relatively to a horizontal bottom wall 24*b* instead of perpendicular to the bottom wall 24*b*. A front upper and lower receptacles 111*b*, 112*b* are perpendicularly formed relative to the front mating face 11*b* with a plurality of first and second terminals 312*b*, 322*b* exposed therein respectively for mating with complementary modular plugs 200*b*. As shown in FIG. 13, the adapter 100*b* further provides an upper and lower latching portions 127*b*, 125*b* latchably engaging with a panel 5*b*. In such arrangement, it is easier for customers to see the receptacles 111*b*, 112*b* and to install plugs accurately. It should be noted that a rear mating face 21*b* can also be alternated angled to the horizontal bottom wall.

Figure 14:
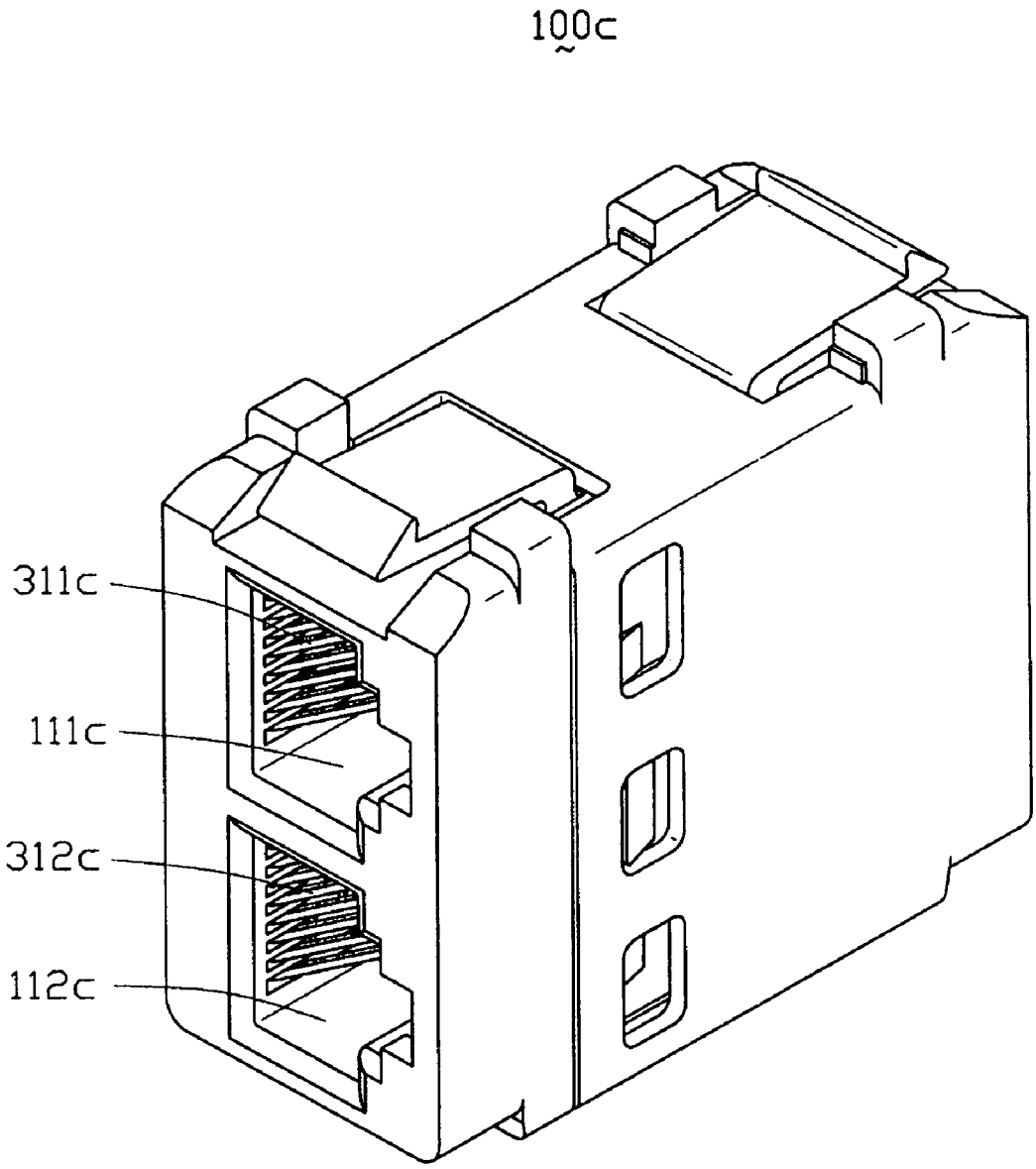
FIG. 14 is a perspective view of the adapter in a forth embodiment.
Figure 15:
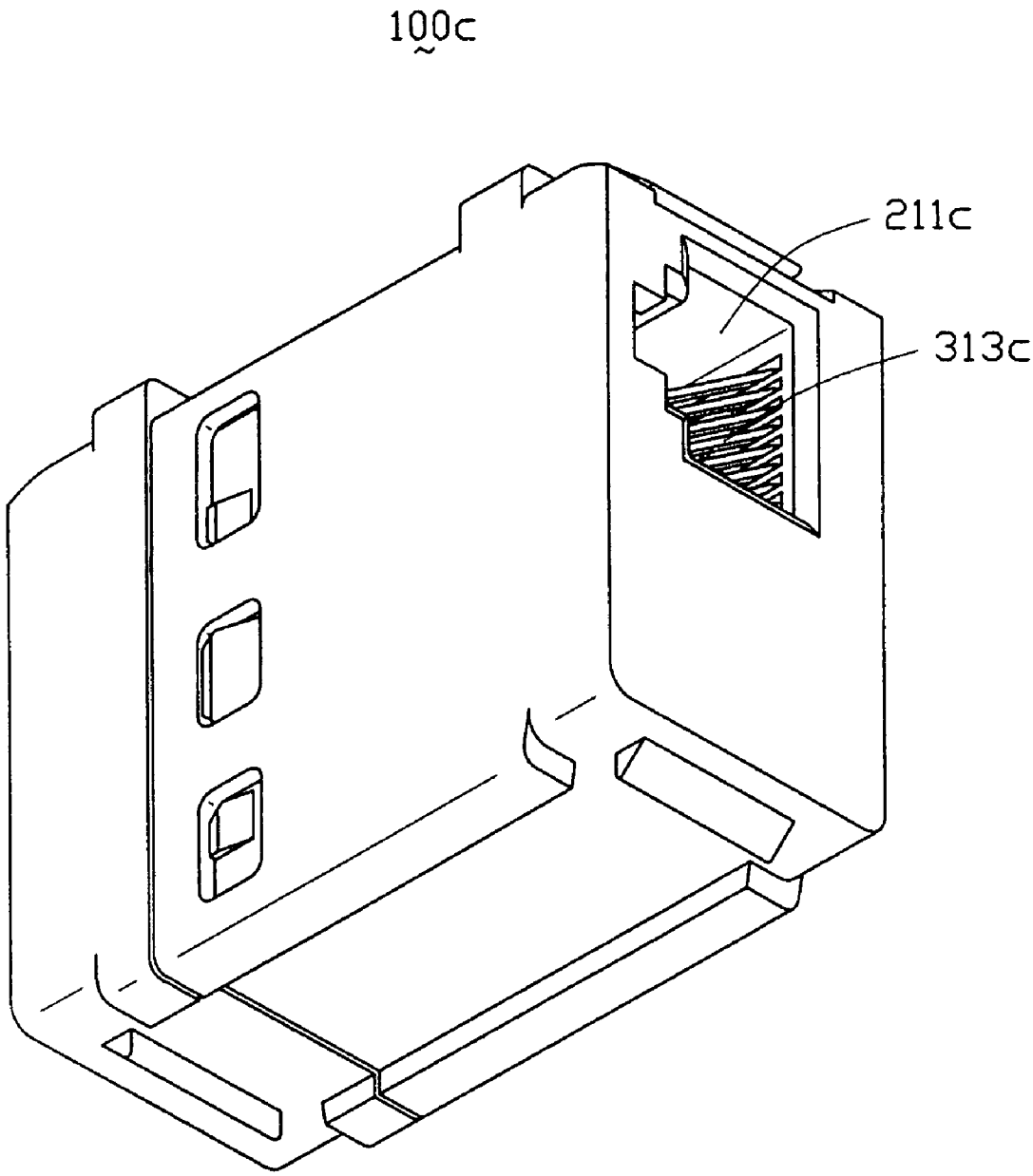
FIG. 15 is anther perspective view of FIG. 14.
Figure 16:
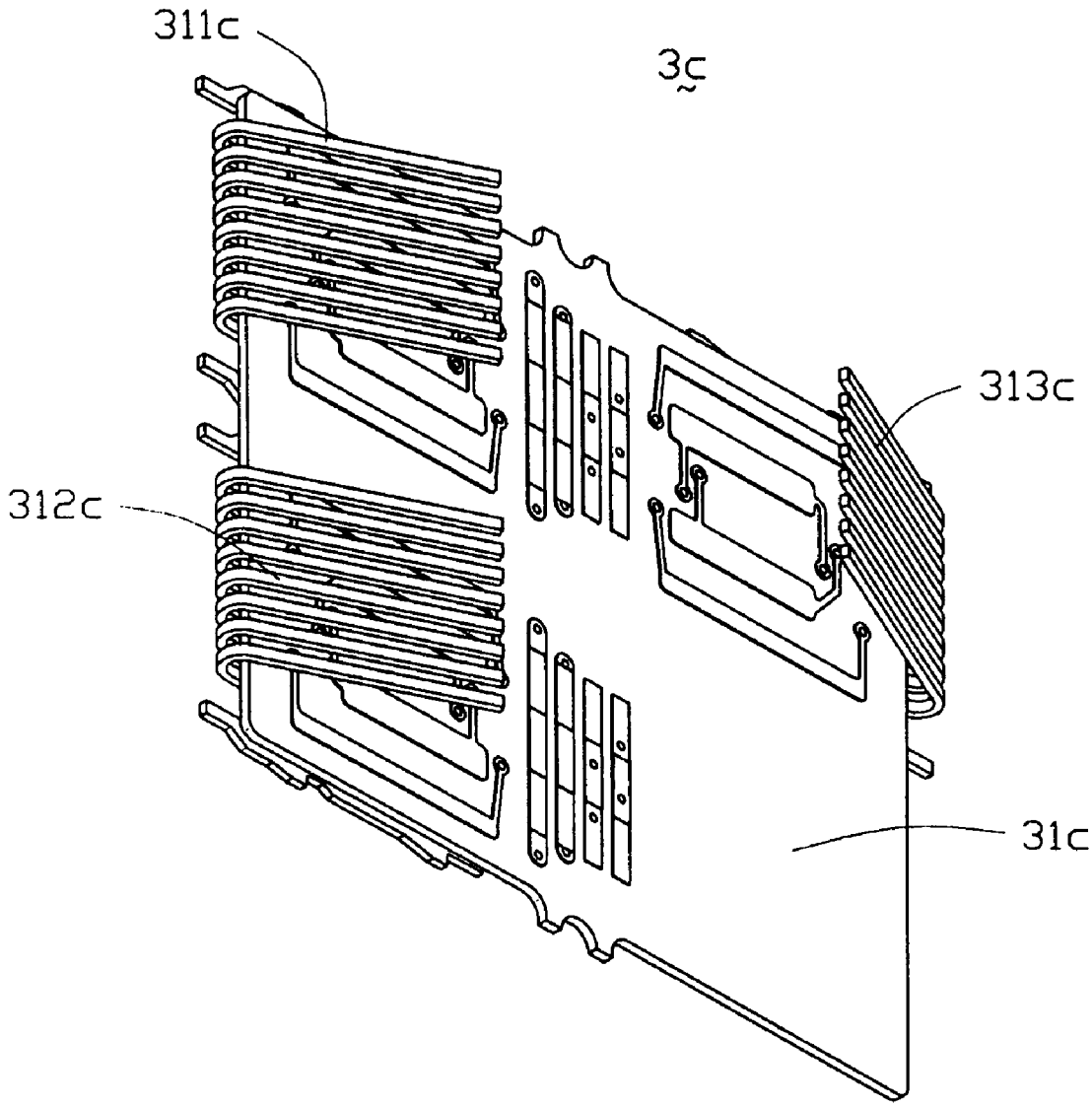
FIG. 16 is a perspective view of a subassembly of the adapter shown in FIG. 14.

Referring now to FIGS. 14–16, a forth embodiment of an electrical adapter 100*c* of the present invention is described. In this embodiment, the adapter 100*c* comprises a dielectric housing providing first, second and third receptacles 111*c*, 112*c*, 211*c*, and a subassembly 3*c*. The subassembly 3*c* comprises a common vertical PCB 31*c* carrying a plurality of first, second and third conductive terminals 311*c*, 312*c*, 313*c* respectively exposed in the first, second and third receptacles 111*c*, 112*c*, 211*c*. The vertical PCB 31*c* is substantially multi-layered for traces and has adequate area to place a number of components, as illustrated in the first embodiment, for modify the electrical signals. It is important to note that the third receptacles 211*c* with the third terminals 313*c* could be located anywhere along the height of the adapter 100*c*.

Figure 17:
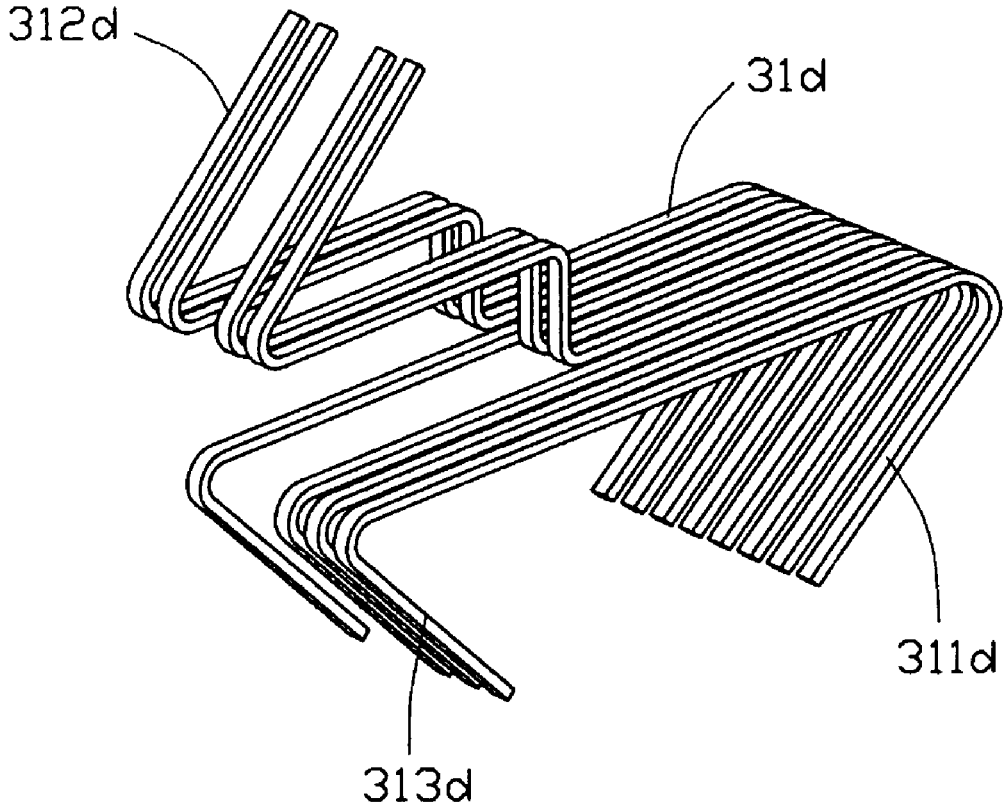
FIG. 17 is a perspective of alternative conductive terminals of the adapters.

In an alternate embodiment shown in FIG. 17, a subassembly 3*d* may comprise only one array of conductive terminals 31*d* each has a pair of mating ends 311*d*, 312*d* (313*d*). In this embodiment, the terminals 31*d* are of eight pieces. One end of the eight terminals 31*d* are provided for receiving in the second receptacle 211, and the other ends 312*d*, 313*d* of the eight terminals 31*d* are divided into two sets which are respectively received in the first upper and lower receptacles 111, 112. It is obvious that a single array of terminals in this embodiment is simplified and is of lower cost.

While terms such as "front", "rear", "upper" and "lower", "horizontal" and "vertical" have been used to help describe the invention as it is illustrated, it should be understood that the adapter 100 can be used in any orientation with respect to earth.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical adapter comprising:

a dielectric housing defining a first mating face having a first and second receptacle defined therein, the housing having a second mating face with respect to the first mating face and defining a third receptacle, each of the receptacles being adapted to receive a plug connector therein; and a plurality of conductive terminals assembled into the housing, and the terminals being arranged into two sets, each set including first and second mating portion;

wherein the first mating portions of each set is arranged in the first and second receptacles, respectively, and the second mating portions of the two sets are arranged commonly in the third receptacle, and wherein each of said terminal set includes a second subsection including the second mating portion, and a first subsection defining the first mating portion, the first and second subsections being interconnected by circuit traces.

2. The electrical adapter according to claim 1, wherein said circuit traces are formed on a common printed circuit board, and wherein said terminals are mounted on the common circuit board and respectively with said first and second mating portion extending into corresponding first, second and third mating ports and interconnected by said circuit traces.

3. The electrical adapter according to claim 2, wherein the common printed circuit board is substantially multi-layered for traces and has adequate area to place active, passive electrical and electromechanical devices.

4. The electrical adapter according to claim 3, wherein the printed circuit board carrying said terminals are vertically located in the housing.

5. The electrical adapter according to claim 1, further including a first, second and third printed circuit boards forming said circuit traces, and a plurality of contact pins interconnected the first, second and third printed circuit boards, and wherein the first and second subsections are respectively mounted on the first, second and third printed circuit boards and interconnected via the circuit traces and the contact pins.

6. The electrical adapter according to claim 5, wherein the first, second and third printed circuit boards are substantially multi-layered for traces and have adequate area to place active, passive electrical and electromechanical devices.

7. An electrical adapter comprising:

a dielectric housing defining a first mating face having a first and second receptacle defined therein, the housing having a second mating face with respect to the first mating face and defining a third receptacle, each of the first second and third receptacles being adapted to receive a plug connector therein; and first, second and third sets of conductive terminals disposed in the corresponding first, second and third receptacles, respectively, wherein each of the three sets of conductive terminals is attached to a corresponding printed circuit board under a condition that all printed circuit boards are commonly supported by at least an insulator, under a condition that the third set of conductive terminals are simultaneously electrically correspondent to both the first and second sets of conductive terminals.

8. The adapter according to claim 7, wherein each terminal in the third set has a one to one relationship with the corresponding terminal in one of the first and second set.

9. An electrical adapter comprising:

a dielectric housing defining a first mating face having a first and second receptacle defined therein, the housing having a second mating face with respect to the first mating face and defining a third receptacle, each of the receptacles being adapted to receive a plug connector therein; and a plurality of conductive terminals assembled into the housing, and the terminals being arranged into two sets, each terminal including a first mating portion and a second mating portion;

wherein the first mating portions of the two sets are arranged in the first and second receptacles, respectively, and the second mating portions of the two sets are arranged commonly in the third receptacle; wherein the dielectric housing includes a first housing member and a second housing member coupled with the first housing member, further including latching means arranged between the first and the second housing members so as to fasten the first housing member and the second housing member together; wherein the latching means includes a plurality of locking portions projecting outwardly from opposite sides of the first housing member, and a plurality of locking holes in opposite sides of the second housing member engaging with corresponding locking portions of the first housing member.

10. The electrical adapter according to claim 9, wherein the first and second receptacles are provided for transmitting same type of signals.

11. The electrical adapter according to claim 9, wherein the first and second receptacles are provided for transmitting different types of signals.

12. The electrical adapter according to claim 9, wherein the first and the second mating faces are defined by the first and second housing member respectively.

13. The electrical adapter according to claim 9, wherein the latching means includes a pair of engaging portions formed on opposite outer sides of the first housing member, and a pair of latching arms integrally formed with sidewalls of the second housing member latchably engaging with corresponding engaging portions of the first housing member.

14. The electrical adapter according to claim 9, further including a grounding clip having a pair of grounding finger tabs respectively disposed in each first and second receptacles for electrically connecting with complementary connectors.

15. The electrical adapter according to claim 9, wherein the adapter has a horizontal axis.

16. The electrical adapter according to claim 15, wherein an angle between the first mating face and the horizontal axis is an obtuse angle or an acute angle.

17. The electrical adapter according to claim 16, wherein an angle between the second mating face and the horizontal axis is an obtuse angle or an acute angle.

18. The electrical adapter according to claim 9, wherein at least one of the first and second housing member forms latching portions projecting outwardly from surfaces thereof adapted for latchably engaging with a window of a panel.

19. An electrical adapter adapted for being mounted on a printed circuit board, comprising:

a first housing member having a first lower mounting surface, a first mating face, and a first receptacle in said first mating face;

a second housing member physically coupled with the first housing member, the second housing member having a second lower mounting surface, a second mating face opposite to said first mating face, and a second receptacle in said second mating face, said first and second mating faces being parallel to each other and both perpendicular to said first and second mounting surfaces;

a plurality of terminals having mating portions extending into said first and second receptacles; and a grounding clip having a first and a second grounding finger tabs respectively disposed in said first and second receptacles for electrically connecting with complementary connectors inserted in the first and second receptacles and forming a continuous ground path between the adapter and the complementary connectors.

20. The adapter according to claim 19, wherein said first housing member has two first receptacles, and wherein said terminals are arranged into two sets, each set including first and second mating portions, the first mating portions of said two sets being respectively arranged in said two first receptacles in the first mating face, and the second mating portions of the two sets being arranged commonly in the second receptacle in the second mating face.

21. The adapter according to claim 20, wherein the first and the second housing member defining grooves for receiving the grounding clip.

* * * * *